US005285250A

United States Patent [19]

Yoshioka

[11] Patent Number: 5,285,250

[45] Date of Patent: Feb. 8, 1994

[54] WASTE TONER COLLECTING DEVICE FOR ELECTROPHOTOGRAPHIC EQUIPMENT

[75] Inventor: Satoru Yoshioka, Yokohama, Japan

[73] Assignee: Ricoh Company, Ltd., Tokyo, Japan

[21] Appl. No.: 59,194

[22] Filed: May 10, 1993

Related U.S. Application Data

[63] Continuation of Ser. No. 734,484, Jul. 23, 1991, abandoned.

[30] Foreign Application Priority Data

Jul. 24, 1990 [JP] Japan ..... 2-78432[U]

[51] Int. Cl.[5] ..... G03G 21/00

[52] U.S. Cl. ..... 355/298; 141/363; 141/375; 198/550.1

[58] Field of Search ..... 355/298; 222/DIG. 1; 198/674, 550.1; 141/363, 364, 365, 375

[56] References Cited

U.S. PATENT DOCUMENTS 1,206,515 11/1916 Danielson ..... 198/550.1 X
2,266,945 12/1941 Abraham ..... 198/674
4,593,997 6/1986 Fox et al. ..... 355/298
4,699,265 10/1987 Houle ..... 198/550.1 X
5,121,168 6/1992 Aoki et al. ..... 355/298

FOREIGN PATENT DOCUMENTS 3707869 9/1987 Fed. Rep. of Germany .
57-163273 10/1982 Japan ..... 355/298
2214605 9/1989 United Kingdom .

*Primary Examiner*—A. T. Grimley
*Assistant Examiner*—Shuk Y. Lee
*Attorney, Agent, or Firm*—Oblon, Spivak, McClelland, Maier & Neustadt

[57] ABSTRACT

A waste toner collecting device incorporated in electrophotographic equipment of the type electrostatically forming a latent image on a photoconductive element, developing the latent image by a toner, and transferring the resulted toner image to a recording medium. The device collects a waste toner having been removed from the photoconductive element after the image transfer in a storing section thereof. An auger for conveying the waste toner to the storing section is operatively connected to a drive shaft by a mechanism which is disposed in the storing section and constituted by pin gears each having a number of uniquely configured pins.

3 Claims, 4 Drawing Sheets

WASTE TONER COLLECTING DEVICE FOR ELECTROPHOTOGRAPHIC EQUIPMENT

The application is a continuation of application Ser. No. 07/734,484, filed on Jul. 23, 1991, now abandoned.

BACKGROUND OF THE INVENTION

The present invention relates to electrophotographic equipment of the type electrostatically forming a latent image on a photoconductive element, developing the latent image by a toner, and transferring the resulted toner image to a recording medium. More particularly, the present invention is concerned with a device incorporated in such equipment for collecting a waste toner having been removed from the photoconductive element after the image transfer.

An electrophotographic copier, laser printer or similar equipment of the type described is extensively used today. It is a common practice with such equipment to incorporate a device for collecting a waste toner which is removed from a photoconductive element by a cleaning device after the transfer of a toner image to be discarded. A predominant type of waste toner collecting device has an auger for conveying the waste toner to a waste toner storing section. The auger is implemented by, for example, a helical wire which is connected to a drive shaft to be rotated thereby. Usually, the auger is operatively connected to the drive shaft by gears or a belt and pulley device. Specifically, when the drive shaft and auger extend perpendicular to each other, the interconnection thereof is implemented by a worm gear or bevel gears.

A problem with the conventional implementation using a worm gear or bevel gears as stated above is that the waste toner conveyed by the auger is apt to enter and fill the space between nearby teeth of each gear element. It is likely, therefore, that the coactive gear elements are partly brought out of mesh to prevent the auger from rotating smoothly. Further, when use is made of a belt and pulley device for the interconnection of the auger and drive shaft, the waste toner is apt to enter the grooves of the pulleys, causing the belt to slip out of the pulleys.

SUMMARY OF THE INVENTION

It is therefore an object of the present invention to provide a waste toner collecting device for electrophotographic equipment which insures the drive transmission from a drive shaft to an auger without being effected by a collected waste toner.

It is another object of the present invention to provide a generally improved waste toner collecting device for electrophotographic equipment.

In accordance with the present invention, a device incorporated in electrophotographic equipment for collecting a waste toner which is removed from a photoconductive element after a toner image formed on the photoconductive element has been transferred to a recording medium comprises a receptacle for collecting and storing the waste toner, an auger for transporting the waste toner to the receptacle, a drive shaft for driving the auger, and a drive transmission mechanism disposed in the receptacle for transmitting the driving force of the drive shaft to the auger. The drive transmission mechanism comprises a first pin gear mounted on one end of the auger which is located in the receptacle, and a second pin gear mounted on one end of the drive shaft in the receptacle and meshing with the first pin gear.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
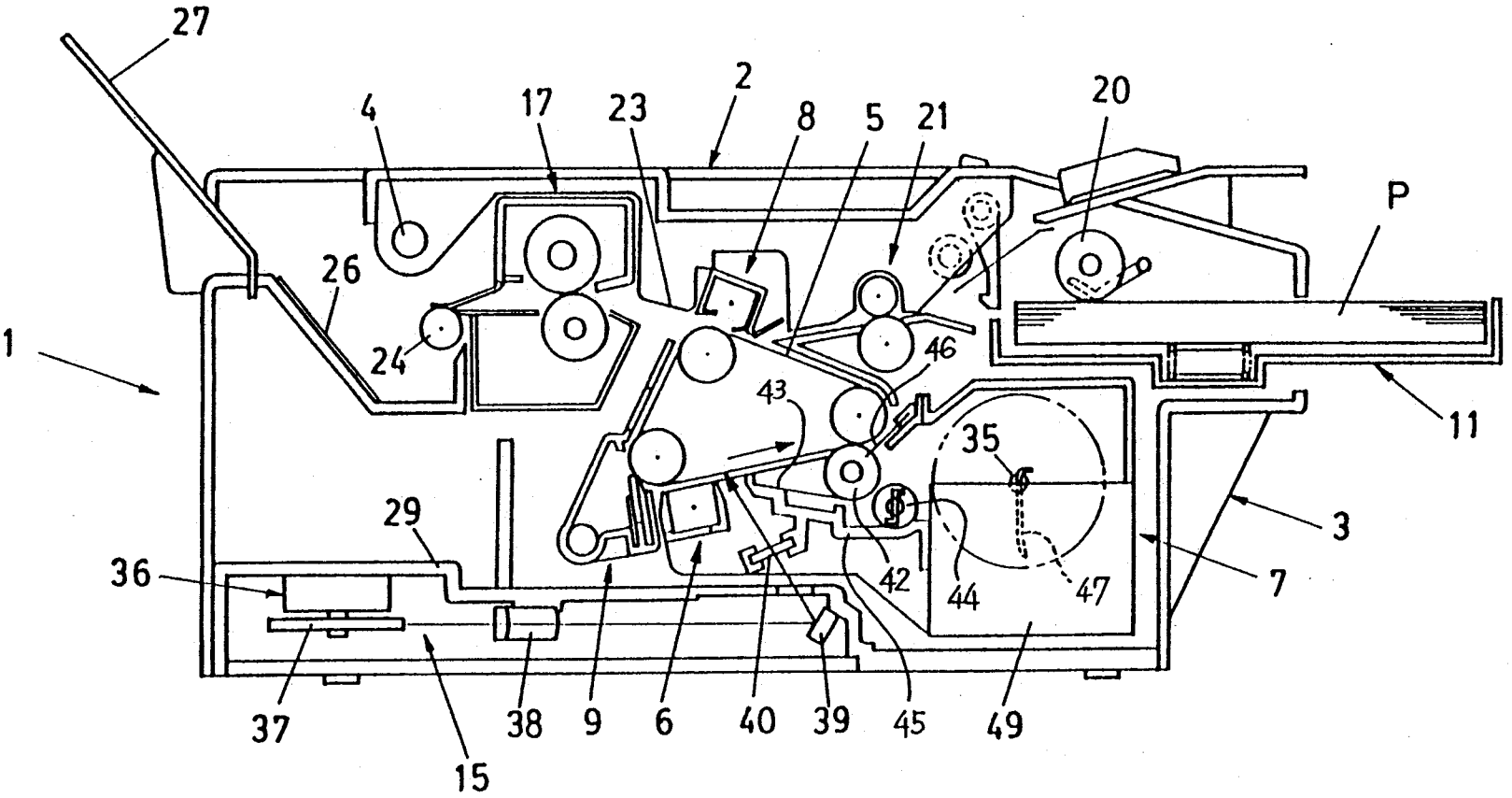
FIG. 1 is a view showing the general construction of electrophotographic equipment with a waste toner collecting device embodying the present invention and implemented as a laser printer by way of example.

Referring to FIG. 1 of the drawings, electrophotographic equipment with a waste toner collecting device embodying the present invention is shown and implemented as a laser printer by way of example. As shown, the laser printer has a body 1 which is made up of an upper casing 2 and a lower casing 3. The upper casing 2 is openably connected to the lower casing 3 by a shaft 4.

A photoconductive element in the form of a belt 5 is located substantially at the center in the body 1. Arranged around the belt 5 are a main charger 6, a developing device 7, a transfer charger 8, a cleaning device 9 and other devices for effecting an electrophotographic process. A paper cassette 11 loaded with a stack of paper sheets is disposed above the developing device 7. An optical writing device 15 is positioned in close proximity to the bottom of the lower casing 3. A paper sheet P fed from the cassette 11 by a feed roller 20 is transported to the upper portion of the belt 5 at a predetermined timing by a register roller pair 21.

The belt 5 is passed over three rollers and rotated in a direction indicated by an arrow in the figure. The main charger 6 uniformly charges the surface of the belt 5. A laser beam issuing from the optical writing device 15 is incident to the charged surface of the belt 5 to electrostatically form a latent image thereon. The developing device 7 develops the latent image by a toner to produce a toner image. The transfer charger 8 transfers the toner image to the lower surface of the paper sheet P having reached the upper portion of the belt 5. The paper sheet P with the toner image is guided by a guide 23 to between a fixing roller and a pressing roller which constitute the fixing device 17. Then, these rollers of the fixing device 17 fix the toner image on the paper sheet P. The paper sheet P come out of the fixing device 17 is further driven by a discharge roller 24 and then guided by a discharge guide 26 to a tray 27.

The optical writing device 15 is disposed in a base cover 29 which is affixed to the lower casing 3. Specifically, a scanner motor 36, a polygonal mirror 37, an f-theta lens 38 and a second mirror 39 constituting the writing device 15 in combination are arranged in the space defined by the base cover 29. A laser beam issuing from a laser unit and having been modulated by an image data signal is incident to the polygonal mirror 37 which is mounted on the output shaft of the scanner motor 36. The polygonal mirror 37 repetitively deflects the incident laser beam over a predetermined angular range. The f-theta lens 38 focuses the laser beaming onto the belt 5 at a predetermined writing position via the second mirror 38 and a cylindrical lens 40. At this instant, the laser beam is corrected such that the point of projection moves at a constant rate. Main scanning and subscanning are respectively effected by the deflection of the laser beam and the rotation of the belt 5. As a result, an image corresponding to the image data signal is written in the belt 5 to electrostatically form a latent image, as stated earlier.

Figure 2:
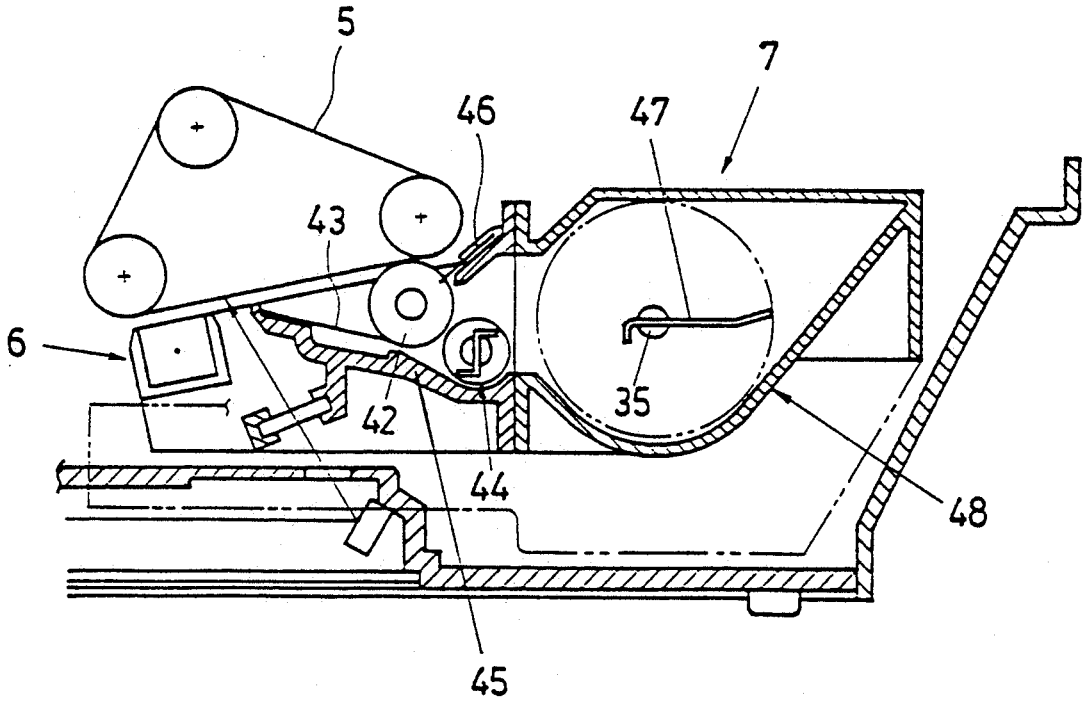
FIG. 2 shows a developing device included in the laser printer specifically.

FIG. 2 shows the general construction of the developing device 7. As shown, the developing device 7 has a frame 45 on which a developing roller 42, a doctor blade 43, a discharge brush and a toner supply member 44 are mounted. Also mounted on the frame 45 is the main charger 6. A toner cartridge 48 is positioned at the right-hand side of the frame 45 as viewed in FIG. 2 and stores a toner therein. An agitator 47 is disposed in the toner cartridge 48 and mounted on a rotary shaft 35. As the shaft 35 is rotated, the agitator 47 mounted thereon agitates the toner within the toner cartridge 48. The toner cartridge 48 is affixed to the frame 45 by suitable technology.

The cleaning device, FIG. 1, collects the toner from the belt 5. This part of the toner, i.e., waste toner is stored in a waste toner storing section 49 shown in FIG. 3. The storing section 49 is mounted on the front side wall of developing device 7 is viewed in FIG. 2. An auger 53 is rotatably disposed in the storing section 49 for transporting the waste toner introduced into the section 49. Also disposed in this section 49 is a mechanism 30 for operatively connecting the auger 53 to the shaft 35 of the agitator 47. The mechanism 30 is implemented by a pin gear 54 mounted on the right end of the auger 53 as viewed in FIG. 3, and a pin gear 55 mounted on the shaft 35 and held in mesh with the pin gear 54. The pin gears 54 and 55 have respectively disk-like bases 54*a* and 55*a* each having a particular thickness. A number of pins 54*b* and a number of pins 55*b* are studded on the circumferential surfaces of the bases 54*a* and 55*b*, respectively. The pins 54*b* have the same length and are positioned at equally spaced locations along the circumference of the base 54*a*. This is also true with the pins 55*b*.

Figure 3:
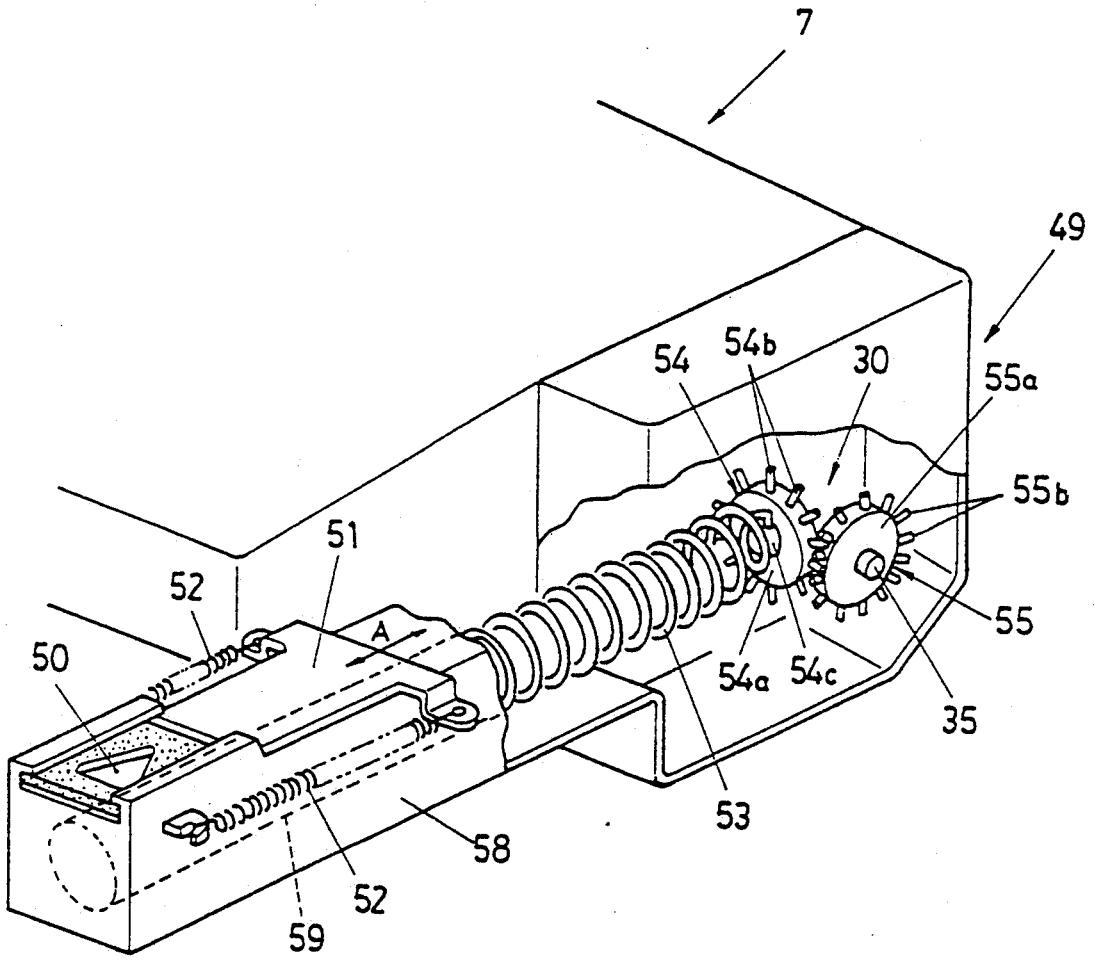
FIG. 3 is a perspective view of the embodiment.

The waste toner storing section 49 has an opening 50 at the leading end (left end as viewed in FIG. 3) thereof for receiving the waste toner transported from the cleaning device 9. The opening 50 is selectively blocked and unblocked by a shutter 51 which is movable in a direction indicated by an arrow A in FIG. 3. The shutter 51 is constantly biased by two shutter springs 52 in a direction for closing the opening 50. When the storing section 49 is inserted into the body of the laser printer in the unit configuration shown in FIG. 3, the shutter 51 abuts against a pin or similar member provided on the printer body. As a result, the shutter 51 is opened against the action of the shutter springs 52. As the storing section 49 is fully set in a predetermined position within the printer body, the shutter 51 is ready to receive the waste toner from the cleaning device 9, as shown in FIG. 3.

The auger 53 is implemented as a helical wire whose diameter is selected such that the wire does not deform during rotation. Part of the auger 53 located at the left-hand side as viewed in FIG. 3 is rotatably received in a bore 59 which is formed in the housing 58 of the storing section 49. The pin gear 54 has a lug or hub 54*c* which is formed with a radially extending hole. The right end of the auger 53 as viewed in FIG. 3 is press-fitted in such a hole of the hub 54*c*. In the illustrative embodiment, the pin gear 54 to which the auger 53 is affixed in the above-mentioned manner is held in mesh with the pin gear 55 which is mounted on the agitator shaft 35. In this configuration, as the agitator shaft 35 is rotated to rotate the agitator 47, FIG. 2, the auger 53 is rotated to transport the waste toner sequentially entering the bore 59 of the housing 58 via the opening 50 toward the storing section 49.

It has been customary to operatively connect the drive shaft 35 and the auger 53 by gears or a belt and pulley device. The problem with such a conventional scheme is that the waste toner is apt to enter the space between nearby teeth of the gears or the grooves of the pulleys, bringing part of the gears out of mesh or causing the belt to slip out of the pulleys. In the illustrative embodiment, the mechanism 30 connecting the drive shaft 35 to the auger 53 is constituted by the intermeshing pin gears 54 and 55 having respectively pins 54*b* and 55*b* each of which has a unique configuration. Such pin gears 54 and 55 are advantageous over, for example, a spur gear, worm gear or helical gear which would have their spaces stopped up by the waste toner. This successful in surely transmitting the drive from the agitator shaft or drive shaft 35 to the auger 53.

Figure 4:
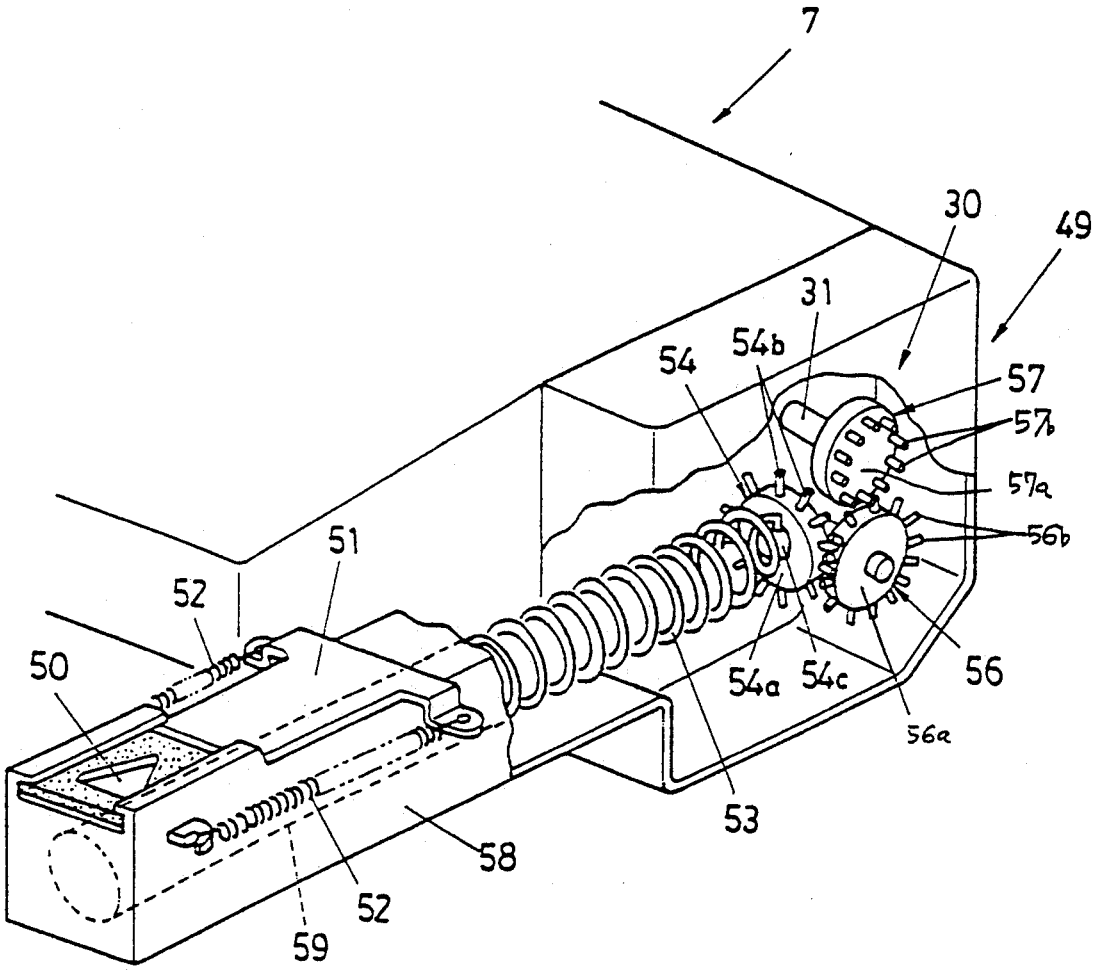
FIG. 4 is a view similar to FIG. 3, showing an alternatative embodiment of the present invention.

Referring to FIG. 4, an alternative embodiment of the present invention will be described. In FIG. 4, the same components as the components of the previous embodiment are designated by like reference numerals, and redundant description will be avoided for simplicity. As shown, the mechanism 30 connects a drive shaft 31 to the auger 53 and is constituted by the pin gear 54, a pin gear 56, and a pin gear 57 mounted on the drive shaft 31. The pin gear 54 meshes with the pin gear 56 which in turns meshes with the pin gear 57. In this manner, a drive shaft other than the agitator shaft 35, FIG. 3, may be used to drive the auger 53.

In summary, it will be seen that the present invention provides a waste toner collecting device for electrophotographic equipment which implements the operative connection of an auger and a drive shaft with pin gears which are free from the influence of waste toner due to the unique configuration of pins thereof. The device, therefore, surely transmits the driving force from the drive shaft to the auger and thereby allows the auger to rotate smoothly.

Various modifications will become possible for those skilled in the art after receiving the teachings of the present disclosure without departing from the scope thereof.

What is claimed is:

1. A device incorporated in electrophotographic equipment for collecting a waste toner which is removed from a photoconductive element after a toner image formed on said photoconductive element has been transferred to a recording medium, said device comprising:

receptacle means for receiving and storing the waste toner, said receptacle means comprising a first section having an opening for receiving the waste toner and a second section for storing the waste toner;

a rotary auger means extending from the first section to the second section of said receptacle means for transporting said waste toner from the first section to the second section of said receptacle means;

drive means for driving said rotary auger means, said drive means extending from the electrophotographic equipment and to a position inside said second section of said receptacle means; and a drive transmission mechanism disposed inside the second section of said receptacle means for transmitting a driving force of said drive means to said rotary auger means;

said drive transmission mechanism comprising a first pin gear mounted on one end of said rotary auger means and located inside the second section of said receptacle means, and a second pin gear mounted on one end of said drive means inside the second section of said receptacle means and meshing with said first pin gear, such that said first and second pin gears transmit said driving force of said drive means to said rotary auger means and prevent said waste toner stored in the second section of said receptacle means from adhering to said first and second pin gears.

2. A device as claimed in claim 1, wherein said first and second pin gears each comprises a disk-like base having a predetermined thickness, and a number of radially outwardly extending pins being equal in length and studded on a circumferential surface of said base at equally spaced locations along the circumference of said base.

3. A device as claimed in claim 2, further comprising a third pin gear interposed between and meshing with said first and second pin gears.

* * * * *